US008156865B2

(12) United States Patent
Luckhardt et al.

(10) Patent No.: US 8,156,865 B2
(45) Date of Patent: Apr. 17, 2012

(54) METHOD OF OPERATING A PRINTING MACHINE AND PRINTING MACHINE FOR CARRYING OUT THE METHOD

(75) Inventors: Ulrich Luckhardt, Köln (DE); Oliver Nowarra, Leimen (DE); Willi Stutz, Neustadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 400 days.

(21) Appl. No.: 12/472,408

(22) Filed: May 27, 2009

(65) Prior Publication Data

US 2009/0293747 A1 Dec. 3, 2009

(30) Foreign Application Priority Data

May 27, 2008 (DE) ..... 10 2008 025 345

(51) Int. Cl.
*B41F 31/30* (2006.01)
*B41F 31/00* (2006.01)

(52) U.S. Cl. ..... 101/352.01; 101/351.1; 101/349.1; 101/350.4

(58) Field of Classification Search ..... 101/352.04, 101/352.09, 352.01, 351.1, 351.3, 350.4, 101/350.3, 349.1
See application file for complete search history.

(56) References Cited

U.S. PATENT DOCUMENTS 2,283,003 A * 5/1942 Frostad et al. ..... 101/182
2,545,836 A * 3/1951 Albrecht ..... 101/137
5,025,726 A * 6/1991 Funabashi et al. ..... 101/352.05
5,152,224 A 10/1992 Guaraldi
5,787,811 A * 8/1998 Achelpohl et al. ..... 101/349.1
6,546,869 B1 4/2003 Eltner et al.
6,634,292 B2 10/2003 Fujiwara et al.
6,874,416 B2 * 4/2005 Fukushima et al. ..... 101/350.3
7,017,481 B2 * 3/2006 Bechberger et al. ..... 101/147

(Continued)

FOREIGN PATENT DOCUMENTS

DE 19520841 A1 12/1996

(Continued)

OTHER PUBLICATIONS

German Patent and Trademark Office Search Report, dated Dec. 9, 2008.

(Continued)

*Primary Examiner* — Ren L Yan
*Assistant Examiner* — Leo T Hinze
(74) *Attorney, Agent, or Firm* — Laurence A. Greenberg; Werner H. Stemer; Ralph E. Locher

(57) ABSTRACT

A method for operating a printing machine in a print operating mode and another operating mode, for example a maintenance mode. In the print operating mode, bringing a vibrating roller periodically into contact with a first roller of an inking unit, driving the first roller rotationally by a first motor, driving a second roller of the inking unit rotationally by a second motor, transmitting no torque from the first motor to the second roller through a clutch therebetween, and activating the first motor by a control device causing the first roller to rotate at a rotational speed in a constant ratio to a rotational speed of the second roller. In the other operating mode, driving the first and second rollers rotationally by the first motor and transmitting torque from the first motor to the second roller through the clutch. A printing machine for carrying out the method Is also provided.

7 Claims, 3 Drawing Sheets

U.S. PATENT DOCUMENTS

| | | | | |
|---|---|---|---|---|
| 2006/0243145 | A1* | 11/2006 | Hieronymus et al. | 101/211 |
| 2009/0101036 | A1* | 4/2009 | Heiler et al. | 101/483 |

FOREIGN PATENT DOCUMENTS

| | | | |
|---|---|---|---|
| DE | 197 15 614 | A1 | 11/1998 |
| DE | 19715614 | A1 | 11/1998 |
| DE | 100 00 903 | A1 | 8/2000 |
| DE | 44 45 964 | B4 | 12/2005 |
| EP | 0 475 120 | A1 | 3/1992 |
| EP | 0475120 | A1 | 3/1992 |
| EP | 0699524 | A2 | 3/1996 |
| EP | 1 167 026 | A2 | 1/2002 |
| GB | 1472654 | A | 5/1977 |
| GB | 2 296 219 | A | 6/1996 |
| GB | 2 324 270 | A | 10/1998 |

OTHER PUBLICATIONS

European Search Report dated Aug. 27, 2009.

* cited by examiner

METHOD OF OPERATING A PRINTING MACHINE AND PRINTING MACHINE FOR CARRYING OUT THE METHOD

CROSS-REFERENCE TO RELATED APPLICATION

This application claims the priority, under 35 U.S.C. §119, of German Patent Application DE 10 2008 025 345.6, filed May 27, 2008; the prior application is herewith incorporated by reference in its entirety.

BACKGROUND OF THE INVENTION

Field of the Invention

The present invention relates to a method for operating a printing machine in a print operating mode and in another operating mode, in particular a maintenance mode. The invention also relates to a printing machine for carrying out the method.

The maintenance of printing machines, which takes place between print jobs, includes changing printing plates and washing inking units. In order to reduce maintenance time, the aim is to carry out the plate change and the washing of the inking units simultaneously. In order to make it possible to carry out those operations simultaneously, the plate cylinder is driven by a main motor of the printing machine and the inking unit is driven by a separate motor. European Patent EP 1 167 026 B1, corresponding to U.S. Pat. No. 6,634,292, describes a printing machine having motors required for that purpose.

A problem with printing machines which has been known for a long time is that of knocking of a vibrating roller. The knocking of the vibrating roller is caused by a difference which exists between the circumferential speeds of those two rollers, when the vibrating roller is impinging onto a distributor roller. That difference gives rise to torsional oscillations which are transmitted from the distributor roller to following rollers and cylinders and reduce the printing quality. Various measures have already been proposed in order to solve that problem.

One measure is to have a separate motor for the distributor roller, as was proposed, for example, in European Patent Application EP 0 475 120 A1, corresponding to U.S. Pat. No. 5,152,224 and German Published, Non-Prosecuted Patent Application DE 197 15 614 A1, corresponding to U.K. Patent Application 2 324 270 A.

Another measure is to have a shift clutch which is associated with the distributing roller and through which the distributing roller is driven in rotation in the washing mode. In printing operation, the shift clutch is opened, and the distributor roller is driven frictionally by an adjacent roller. That measure is described in German Patent DE 4445964 B4.

SUMMARY OF THE INVENTION

It is accordingly an object of the invention to provide an improved method for operating a printing machine and a printing machine for carrying out the method, which overcome the hereinafore-mentioned disadvantages of the heretofore-known methods and devices of this general type and which are improved in terms of shortening of a maintenance time and/or in terms of a reduction in knocking of a vibrating roller.

With the foregoing and other objects in view there is provided, in accordance with the invention, a method for operating a printing machine in a print operating mode and in another operating mode. In the print operating mode, a vibrating roller is brought periodically into contact with a first roller of an inking unit of the printing machine. Moreover, in the print operating mode, the first roller is driven in rotation by a first motor and a second roller of the inking unit is driven in rotation by a second motor. In the print operating mode, no torque is transmitted from the first motor to the second roller through a clutch disposed between the first motor and the second roller. In the print operating mode, the first motor is activated by a control device in such a way that the first roller rotates at a rotational speed which is in a constant ratio to a rotational speed of the second roller. In the method according to the invention, in the other operating mode, the first roller and the second roller are driven in rotation by the first motor, and in this case a torque is transmitted from the first motor to the second roller through the clutch.

In accordance with another mode of the invention, the other operating mode is a maintenance mode, for example a cleaning mode. The inking unit can be washed in this cleaning or maintenance mode.

In accordance with a further mode of the invention, in the print operating mode, the motor current of the first motor is increased periodically through the use of the control device. These motor current increases may in each case take place shortly before the impingement of the vibrating roller onto the first roller so that, through the use of the motor current increases, the circumferential speed of the first roller is kept constant in spite of the impingement.

In accordance with an added mode of the invention, in the print operating mode, the clutch is rotated, while at the same time a dead travel of the clutch is preserved. In this case, in the print operating mode, the dead travel may be preserved between a first clutch half and a second clutch half of the clutch in the circumferential direction. For this purpose, in the print operating mode, the first clutch half may be driven in rotation by the first motor and, at the same time, the second clutch half may be driven in rotation by the second motor. The two clutch halves may be driven in coordination with one another in such a way that neither of the two clutch halves drives the other and, as seen in the circumferential direction, there is a dead travel or play between a driving surface of the first clutch half and a driving surface of the second clutch half.

With the objects of the invention in view, there is concomitantly provided a printing machine, which is constructed for carrying out the method according to the invention or the method corresponding to one of the developments thereof. This printing machine is preferably a lithographic offset printing machine for the printing of sheets.

Other features which are considered as characteristic for the invention are set forth in the appended claims.

Although the invention is illustrated and described herein as embodied in a method for operating a printing machine and a printing machine for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
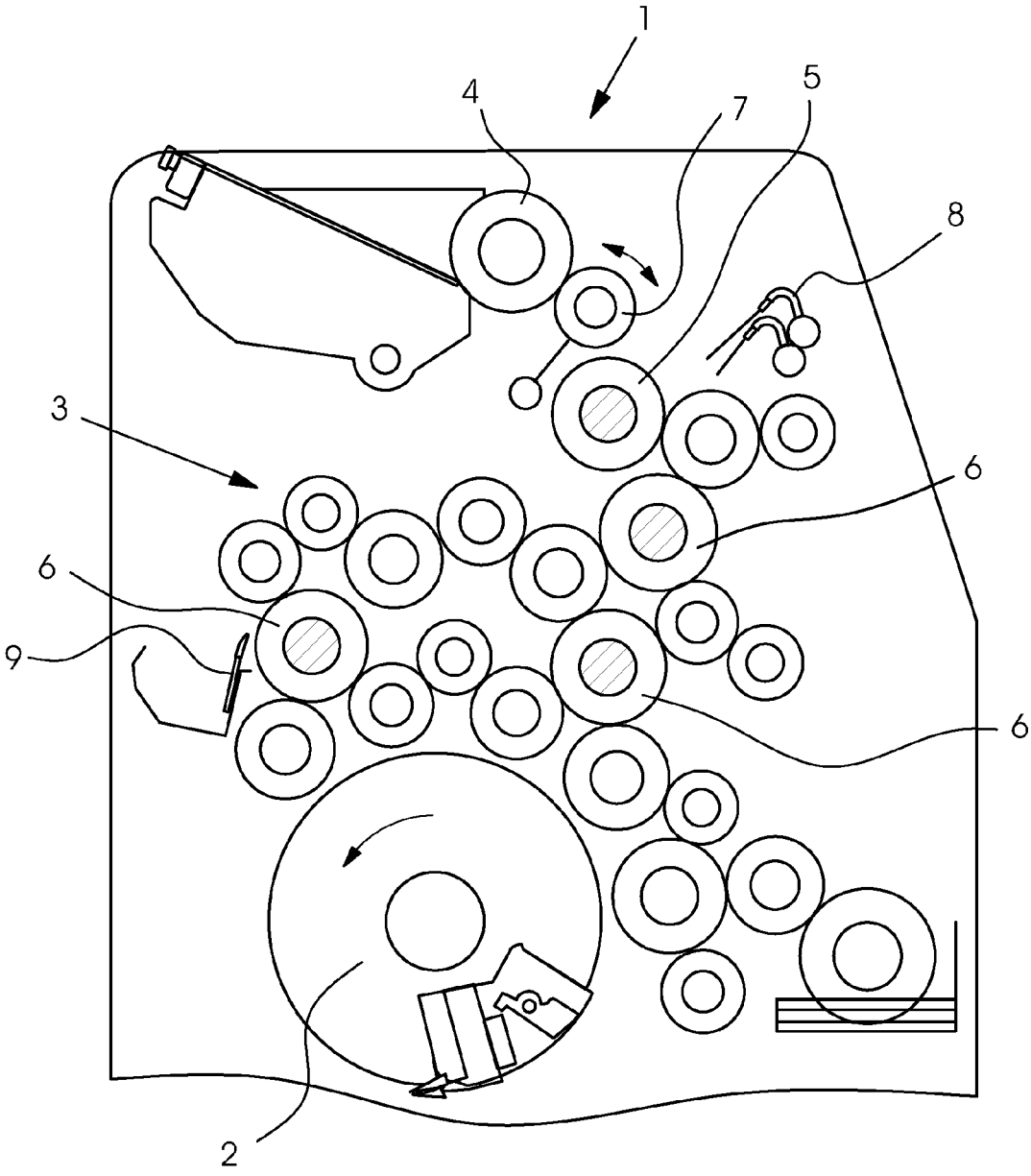
FIG. 1 is a cross-sectional view of a printing machine with an inking unit which has rollers and a drive mechanism for driving the rollers.

Referring now in detail to the figures of the drawings, with which functionally and structurally advantageous developments of the invention are described in an exemplary embodiment, and first, particularly, to FIG. 1 thereof, there is seen a portion of a printing machine 1 for the printing of sheets. The fragmentary view shows a printing unit for offset printing. The printing unit includes an impression cylinder and a blanket cylinder which are not illustrated in the drawing. Furthermore, it includes a printing form cylinder 2, a dampening unit, which is not designated in any further detail, for dampening the printing form cylinder 2, and an inking unit 3 for inking the printing form cylinder 2. The inking unit 3 is a vibrating inking unit and includes an ink fountain with an ink fountain roller 4, a first roller 5, a plurality of second rollers 6 and further rollers, which are not designated in any further detail, including transfer rollers and applicator rollers. The second rollers 6 are driven in rotation through gearwheels which are disposed coaxially with and connected fixedly in terms of rotation to the second rollers 6. These gearwheels are integral parts of a gear 23 (see FIG. 2). Furthermore, the inking unit 3 includes a vibrating roller 7 which oscillates back and forth between the ink fountain roller 4 and the first roller 5 and which in this case comes alternately into contact with the two rollers 4, 5. A spraying device 8 for feeding washing agent and rinsing water into the inking unit 3 and a doctor device 9 for subsequent removal of a washing-agent/printing-ink mixture from the inking unit 3, are present for a cleaning mode.

Figure 2:
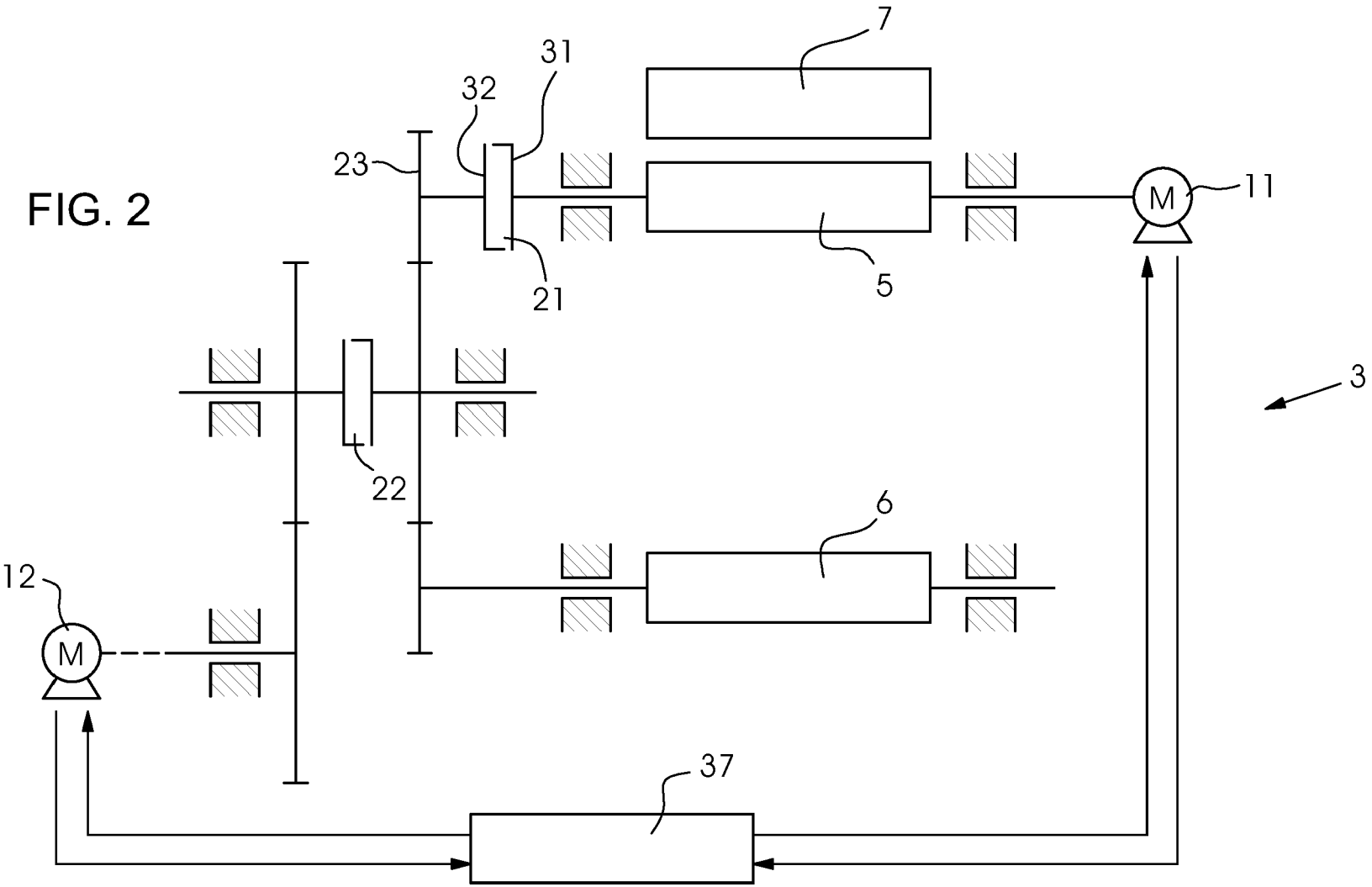
FIG. 2 is a schematic diagram illustrating the drive mechanism which has clutches for the transmission of torques.

FIG. 2 shows that a first motor 11 for the rotary drive of the first roller 5 is connected to the latter. In the exemplary embodiment shown, the first motor 11 is disposed coaxially with the first roller 5, so that the motor shaft of the first motor 11 and the geometric axis of rotation of the first roller 5 are in alignment with one another. A second motor 12 is connected to these rollers 6 through the previously-mentioned gear 23, for the rotary drive of the second rollers 6. The motors 11, 12 are electric motors. The second motor 12 is a so-called main drive of the printing machine 1 and, inter alia, also drives the printing form cylinder 2 (see FIG. 1) in rotation. The first motor 11 is a separate motor and can be activated through the use of an electronic control device 37 as a function of the second motor 12. In addition to the gearwheels, a first clutch 21 and a second clutch 22 are also integral parts of the gear 23.

The first roller 5 is disposed between the first motor 11 and the first clutch 21, so that a torque generated by the first motor 11 can be transmitted to the first clutch 21 through the first roller 5. The first clutch 21 is disposed between the first roller 5 and a gearwheel, coaxial with the first roller 5, of the gear 23 and temporarily connects this gearwheel to the first roller 5 fixedly in terms of rotation when the clutch 21 is in its clutch position provided for this purpose. The first clutch 21 includes a first clutch half 31, which is permanently connected, fixedly in terms of rotation, to the first roller 5 and therefore to the first motor 11. The first clutch 21 also includes a second clutch half 32, which is permanently connected, fixedly in terms of rotation, to the gearwheel coaxial with the first roller 5.

The second clutch 22 is a shift clutch which is assigned a non-illustrated actuating drive which opens the second clutch 22 so that it does not transmit any torque and which closes it so that it transmits torque. The second clutch 22 is disposed between two gearwheels of the gear 23, in order to transmit the torque generated by the second motor 12 from one of the two gearwheels coaxial with the second clutch 22 to the other, in the closed shift position of the second clutch 22.

Figure 3A:
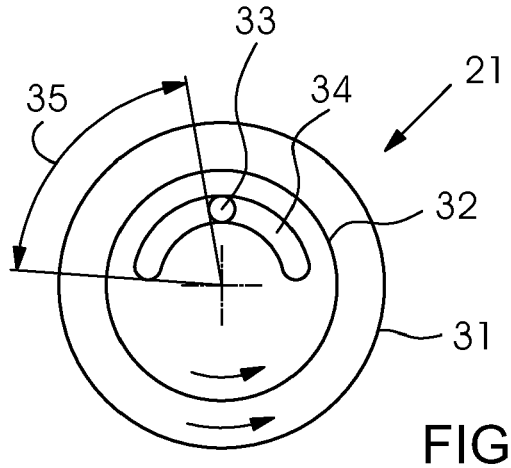
FIG. 3A is a side-elevational view of one of the clutches in a rotary angle position, assumed during printing operation, of two clutch halves in relation to one another, in which no torque transmission takes place.
Figure 3B:
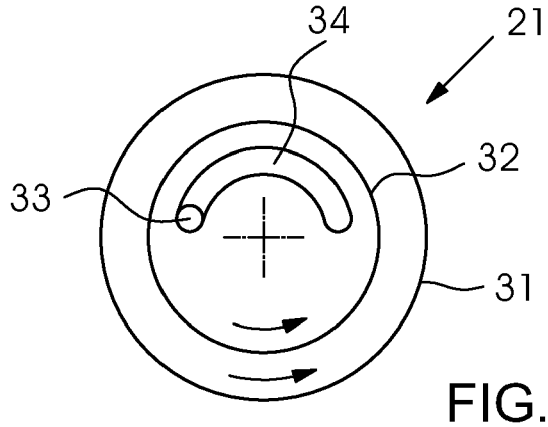
FIG. 3B is a side-elevational view of the clutch of FIG. 3A in a rotary angle position which is assumed during a mode for cleaning the inking unit and in which a torque is transmitted from a first clutch half to a second.

FIGS. 3A and 3B show the structural set-up of the first clutch 21 in simplified form. One of the two clutch halves 31, 32, in this case the first clutch half 31, has a driver 33 which, in the closed position (see FIG. 3B) of the first clutch 21, bears against a stop surface of the other clutch half, in this case the second clutch half 32. The driver 33 is disposed eccentrically with respect to the geometric axis of rotation of the clutch halves 31, 32. The driver 33 may, for example, be a pin which is parallel to the axis of rotation and which is seated fixedly in the first clutch half 31, or may be a projection acting in a functionally identical way to such a pin. The driver 33 projects into a groove 34 in the form of an arc of a circle, which is introduced into the second clutch half 32. The above-mentioned stop surface is formed by an inner end face of the groove 34. The driver 33/groove 34 combination may have a further such combination disposed diametrically thereto. Three or more drivers 33 distributed equally in the circumferential direction may also be disposed on the first clutch half 31 and grooves 34 corresponding to these drivers may be disposed on the second clutch half 33.

The illustrated system functions as follows:

During printing operation, the second motor 12 drives the second rollers 6 in rotation through the gear 23. In this case, the second clutch 22 is closed. During this printing operation, the first motor 11 drives the first roller 5 in rotation. In this case, a torque generated by the first motor 11 is transmitted through the first roller 5 to the first clutch half 31 which is connected fixedly in terms of rotation to the first roller 5. In printing operation, the control device 37 activates the first motor 11 as a function of the rotational speed of the second rollers 6 or as a function of the rotational speed of the second motor 12 driving the second rollers 6, in such a way that the driver 33 does not come into contact with the stop surface located at the end of the groove 34. In printing operation, therefore, the first motor 11 rotates the first clutch half 31 in such a way that a dead travel 35 is ensured between the driver 33 of the first clutch half 31 and the stop surface of the second clutch half 32 which is rotated by the second motor 12. During printing operation, there is no rotary drive of the second clutch half 32 by the first clutch half 31. However, the two clutch halves 31, 32 rotate synchronously with one another, with the driver 33 being located approximately in the middle of the groove 34, as is illustrated in FIG. 3A.

Figure 4:
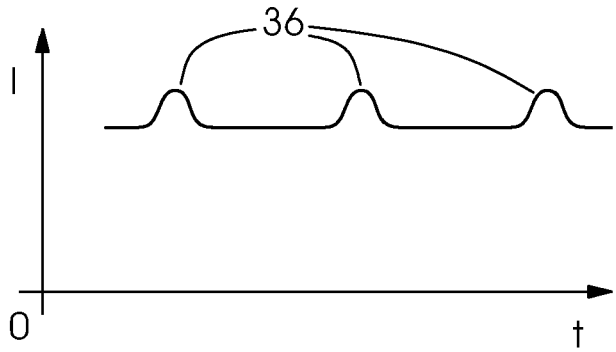
FIG. 4 is a graph which shows periodic motor current increases of a motor of the inking unit which take place during printing operation.

FIG. 4 illustrates a graph, the ordinate of which indicates the current intensity I and the abscissa of which indicates the time t. The curve in the graph shows the motor current of the first motor 11 plotted against the time t. Periodically recurring current increases 36 can be seen, which take place in rhythm with the oscillation of the vibrating roller 7. Each of the current increases 36 takes place shortly before a contact of the vibrating roller 7 with the first roller 5, in which the contact recurs with the same periodicity. The first motor 11 is therefore pilot-controlled with an increased current shortly before the more rapidly rotating first roller 5 accelerates the more slowly rotating vibrating roller 7 in rotation during the contact of the two rollers 5, 7 with one another, so that a sufficient torque is available for this acceleration of the vibrating roller 7 and therefore no excessive slip occurs within the inking unit 3 between the first roller 5 and the second rollers 6 during an acceleration phase. The acceleration of the vibrating roller 7 is therefore ensured by the first roller 5, without a collapse of the rotational speed of the first roller 5 and a resulting slip of the first roller 5 with respect to the remaining inking unit 3 occurring. The torque pulse of the vibrating roller 7, which is known as knocking of the vibrating roller, can be at least partially compensated through the use of torque pilot control, without the automatic control having to react to a deviation in rotational speed. Torque pilot control takes place on the basis of a characteristic diagram which, as a function of the rotary angle of the machine and the rotational speed of the machine, describes the torque to be pilot-controlled. It is recommended, in addition to the rotational speed control loop described, to provide an acceleration control loop. This can measure the current acceleration of the first roller 5, for example through the use of a Ferraris sensor, and can react very quickly to the spurious torque of the vibrating roller 7, even before the rotational speed of the first roller 5 collapses.

In the mode for cleaning the inking unit, which is a maintenance mode, the washing agent and the rinsing water are introduced successively into the inking unit 3 through the use of the spraying device 8, and the soiled washing agent is removed from the inking unit 3 through the use of the doctor device 9. In this maintenance mode, the second clutch 22 is opened, so that the second rollers 6 are no longer driven in rotation by the second motor 12 in this case. In the maintenance mode, the second rollers 6 are driven, together with the first roller 5, by the first motor 11, with the first clutch 21 being closed. The first clutch 21, which is a so-called self-shifting clutch, is closed in that, as a result of the torque transmitted to the first clutch half 31 by the first motor 11, the driver 33 comes into contact with the stop surface formed at the end of the groove 34 and is held, with the dead travel 35 having the value zero, as is illustrated in FIG. 3B. In the case of the self-shifting clutch illustrated in the exemplary embodiment, the shift condition is therefore the rotary angle which one clutch half assumes in relation to the other clutch half.

According to a non-illustrated modification, the first clutch 21 is not constructed as a self-shifting clutch, but as a shift clutch which is shiftable, for example, through the use of an actuating drive.

The rollers 5, 6, as well as being driven in the manner described in connection with the maintenance mode, in which these rollers 5, 6 are driven only by the first motor 11, may also be driven in other operating modes different from printing operation, for example during a so-called ink run-in.

What is claimed is:

1. A method for operating a printing machine in a print operating mode and in another operating mode, the method comprising the following steps:

providing an inking unit with a vibrating roller and first and second rollers;

providing first and second motors;

providing a clutch between the first motor and the second roller;

in the print operating mode, bringing the vibrating roller periodically into contact with the first roller;

rotationally driving the first roller with the first motor;

rotationally driving the second roller with the second motor, and transmitting no torque from the first motor to the second roller through the clutch;

activating the first motor with a control device for rotating the first roller at a rotational speed being in a constant ratio to a rotational speed of the second roller; and in the other operating mode, rotationally driving the first roller and the second roller with the first motor, and transmitting a torque from the first motor to the second roller through the clutch.

2. The method according to claim 1, wherein the other operating mode is a maintenance mode.

3. The method according to claim 2, which further comprises washing the inking unit in the maintenance mode.

4. The method according to claim 1, which further comprises periodically increasing a motor current of the first motor with the control device in the print operating mode.

5. The method according to claim 4, which further comprises carrying out the step of increasing the motor current of the first motor in each case shortly before an impingement of the vibrating roller onto the first roller, for keeping a circumferential speed of the first roller constant with the motor current increases, in spite of the impingement.

6. The method according to claim 1, which further comprises, in the print operating mode, rotating the clutch while at the same time preserving a dead travel of the clutch.

7. The method according to claim 6, which further comprises, in the print operating mode, preserving the dead travel between a first clutch half and a second clutch half of the clutch in circumferential direction.

* * * * *